US007008281B2

(12) United States Patent
Ketko

(10) Patent No.: US 7,008,281 B2
(45) Date of Patent: Mar. 7, 2006

(54) CHILD CARRIER FLOATATION ENHANCEMENT

(76) Inventor: Leslie E. Ketko, 19125 Devonshire, Beverly Hills, MI (US) 48025

( * ) Notice: Subject to any disclaimer, the term of this patent is extended or adjusted under 35 U.S.C. 154(b) by 3 days.

(21) Appl. No.: 10/758,978

(22) Filed: Jan. 14, 2004

(65) Prior Publication Data

US 2005/0153608 A1 Jul. 14, 2005

(51) Int. Cl.
*B63C 9/08* (2006.01)
*B63C 9/30* (2006.01)

(52) U.S. Cl. ..... 441/130; 441/80; 297/250.1

(58) Field of Classification Search ..... 441/125–132, 441/80, 88; 114/345, 363; 297/183.1–183.9, 297/184.13, 217.1, 219.12, 250.1
See application file for complete search history.

(56) References Cited

U.S. PATENT DOCUMENTS

| | | | | | |
|---|---|---|---|---|---|
| 2,075,374 | A | * | 3/1937 | Tucker | 441/131 |
| 3,984,888 | A | * | 10/1976 | DeLano | 441/132 |
| 4,376,551 | A | * | 3/1983 | Cone | 297/256.13 |
| 4,725,253 | A | * | 2/1988 | Politte | 441/130 |
| 4,973,278 | A | * | 11/1990 | Williams | 441/131 |
| 5,143,420 | A | * | 9/1992 | Switlik | 297/216.11 |
| 5,219,203 | A | * | 6/1993 | Switlik | 297/216.11 |
| 5,409,411 | A | * | 4/1995 | Schrieber | 441/80 |
| 6,059,360 | A | * | 5/2000 | Bedard | 297/250.1 |
| 6,412,865 | B1 | * | 7/2002 | Bedard | 297/250.1 |
| 6,482,060 | B1 | * | 11/2002 | Gorny et al. | 441/130 |
| 6,589,089 | B1 | * | 7/2003 | Glass et al. | 441/130 |
| 6,702,380 | B1 | * | 3/2004 | Bedard | 297/250.1 |

FOREIGN PATENT DOCUMENTS

| | | | |
|---|---|---|---|
| GB | 2108435 | A * | 5/1983 |
| JP | 06199164 | A * | 7/1994 |
| JP | 11028170 | A * | 2/1999 |
| JP | 11206918 | A * | 8/1999 |
| WO | WO 200202398 | A1 * | 1/2002 |

* cited by examiner

*Primary Examiner*—S. Joseph Morano
*Assistant Examiner*—Ajay Vasudeva
(74) *Attorney, Agent, or Firm*—Douglas W Rudy

(57) ABSTRACT

A floatation enhancing structure for providing improved flotation of a baby seat, a car seat, or a child/infant carrier includes a buoyant collar that is attached to the seat or carrier generally horizontal to the plane of the seat in repose. A vertical hoop or buoyant material is connected to a carrying handle of the carrier. The vertical hoop will serve to assist in righting the carrier in the event the carrier is inadvertently dropped into a significant body or water having depth sufficient to allow self-righting of the floatation enhanced baby seat. Variations and methods with different advantageous features are also described.

10 Claims, 3 Drawing Sheets

FIG. 1
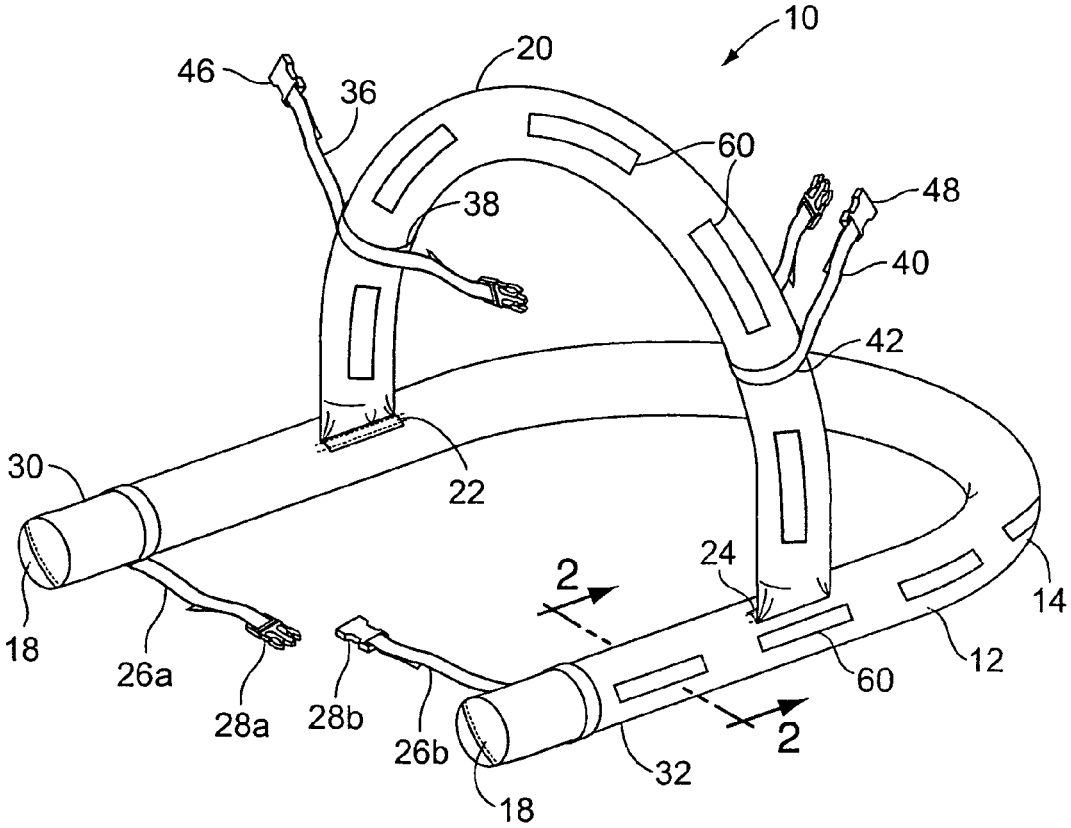
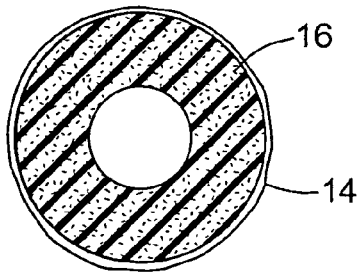
FIG. 2

FIG. 5
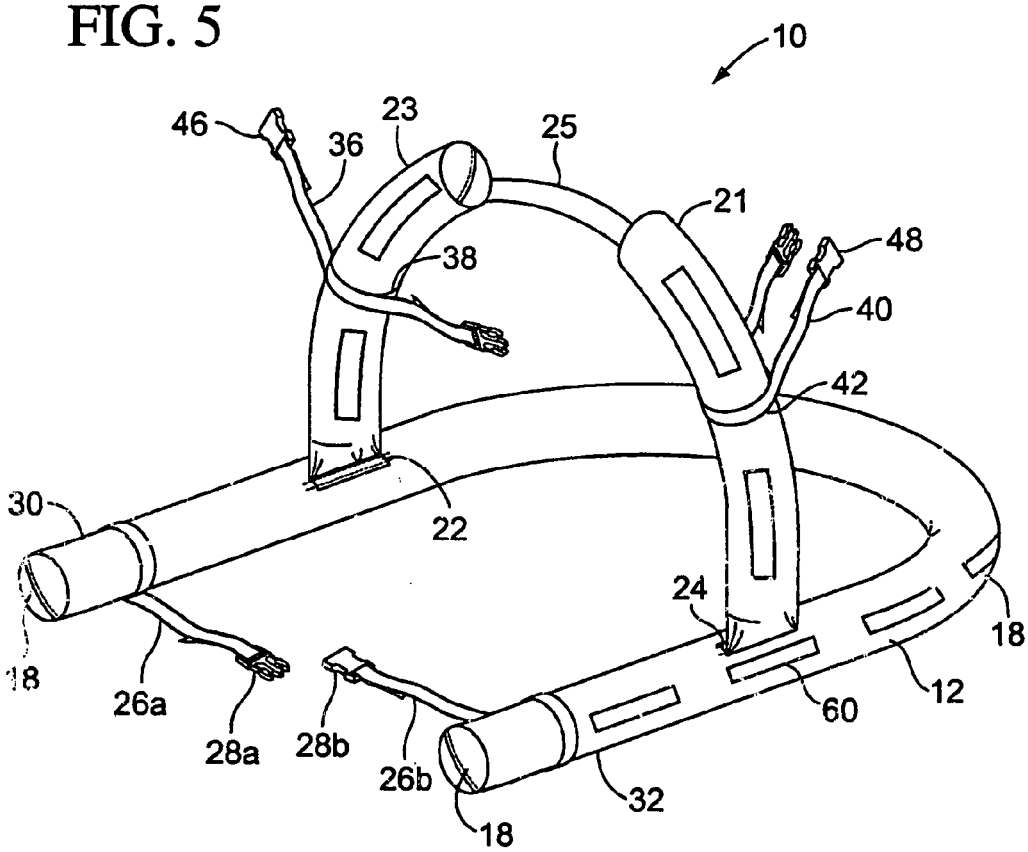
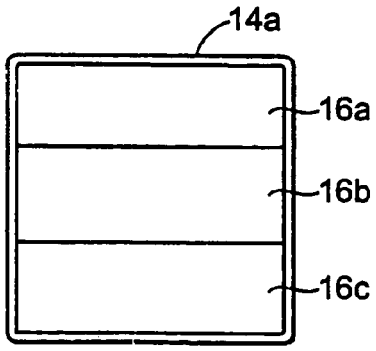
FIG. 6
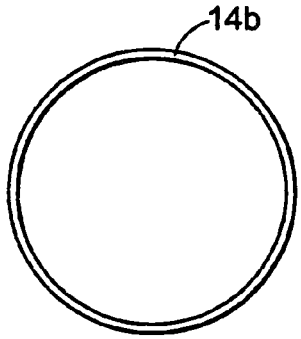
FIG. 7

CHILD CARRIER FLOATATION ENHANCEMENT

BACKGROUND OF THE INVENTION

A system and apparatus for enhancing the safety of a child's car seat or baby carrying seat, particularly, a system and apparatus for improving the floatation of a standard child's car seat or infant carrier is disclosed. Floatation of such an infant carrier is improved by attaching high floatation elements to the existing frame of the carrier.

BRIEF SUMMARY OF THE INVENTION

Carriers for use in carrying infants have become popular. These carriers, referred to as infant seats, infant carriers, child carriers, or baby car seats, allow and provide a safe, effective and efficient way of containing an infant, baby or young child, both when in a car or when being carried to and fro outside the confines of the car. The baby car seat is usually a two component device that allows one component, the receiver, to be semi-permanently mounted in a car using standard or special seat belts. The second component is attached to the receiver when the child carrier is placed in the car. The infant carrier component is easily removed from its secure attachment to the receiver to become a highly transportable baby carrier. The baby or infant carrier, hereinafter a "child carrier" or "infant carrier," is generally a tub shaped pod, the seat part of the child carrier itself, to which a handle is attached. The seat part of the infant carrier is lined with a removable, washable padding and seat cover on which the infant is placed. The infant seat also is equipped with seat belts or straps to hold the infant in the carrier. The handle of the infant carrier will normally pivot on the pod or seat frame portion of the infant carrier. The handle may be, and normally is, generally locked in a position above the seat portion to provide a carrying device by which the basket or tub-shaped pod carrier may be carried. A child carrier of the type envisioned by the inventor is made by many companies and these child carriers are available at specialty stores for children's merchandise, general merchandise stores, and car dealers.

The enhancement disclosed herein is a flotation enhancing structure that will be attached to the child carrier for times when the child carrier is used around water. For instance, an infant carrier is often set on a deck adjacent a swimming pool while the guardian of the infant enjoys sitting by the pool and monitoring activities. Also, many families have boats and will take their infant on the boat to enjoy the boating experience. The dock and boat launch environment presents a water hazard and is dangerous. The child carrier could be inadvertently knocked, kicked or dropped into the water. A infant carrier placed on the dock presents a trip hazard and a person walking on the dock could trip over the carrier and knock it into the water. In the event of such occurrence a self-righting, floating infant carrier device could prevent an unfortunate accident. To help make the child carrier more visible a high visibility safety color cover, such as, but not limited to, red, orange, yellow or a florescent color, could be incorporated into the device. The high visibility cover could help make people aware of the presents of the infant carrier on a dock, on a boat or around a swimming pool. Similarly, reflective tape, panels, or fabric could also be used.

It is known to use Personal Floatation Devices ("PFD") or life jackets, on children. Such "PFDs" are designed for human bodies that are larger than infant size. Usually the child-size PFDs are sized for children that can move around on their own and thus would be in danger in a water hazard environment, such as on a boat, around a pool, a lake or at an amusement park. Contemporary PFDs often have a collar or head support element to right a child in the water and keep the child's head or at least the child's breathing passages from being submerged. The flotation element of the PFD known to the applicant may be made up of layers of closed cell foam. Alternatively, the floatation/buoyancy may be of a solid mass of molded foam. These floatation or buoyancy compositions are known in the industry as they have been in use for years. Another alternative is to use an inflatable bladder or tube to provide the element of floatation and buoyancy.

This specification discloses an apparatus and a method of using the apparatus. A floatation structure is provided to attach to the common infant carrier using straps, belts, flaps with button fasteners, hook and loop fasteners, snap fasteners or the like. The flotation structure will be strapped or otherwise fastened to the perimeter of the seat portion of the carrier and also, in a preferred embodiment, be strapped to the handle of the carrier. The structure disclosed herein will provide improved floatation and buoyancy to the infant carrier to assist in holding the carrier in an upright and normal position of repose in the event the infant carrier is dropped into a significant body of water. For instance, if the infant carrier is set down properly on a dock as the parents load articles on a boat and the carrier is accidentally knocked or kicked into the water, the infant carrier will right itself to an upright position emulating the normal position of repose of the carrier. It may not, in all situations, be an identical angular position as when the carrier is set on a dry surface, but the position of repose of the infant carrier in the water will be such that the infant carrier floats with the strapped-in infant occupant in a relatively safe manner with the infant's breathing passages above the surface of the water.

It is an object of the invention to provide an attachable floatation collar to improve the floating capability and buoyancy of a child's car seat or infant carrier. The floatation structure may comprise a U-shaped floatation element or tube horizontally positioned around the perimeter of the car seat or infant carrier and a generally vertically disposed hoop-like floatation element to be secured to the handle of the infant carrier.

One object and advantage of the flotation structure is that it will float a child seat or infant carrier with the child safely supported with his or her head out of the water, assuming appropriate design as determined and verified by a significant testing regimen.

Also an object of the invention is to provide a floatation device for use on an infant carrier that will be self-righting, again as designed, proven and verified by a manufacturer, to perform the function disclosed herein.

An advantage of the structure presented is that the floatation enhancing device is easily attached using straps, flaps or other fasteners to a child or infant carrier. The device is designed to be lightweight and durable.

It is also an object of the invention to provide an easily storable flotation structure that can be stored in a handy storage bag or in a small space when not needed and then quickly deployed and attached to an infant carrier when needed. That is, the floatation structure will be deployed and attached when the infant carrier is being used near a significant body of water such as near a pool, lake, river, or on a dock or boat.

Another object of the invention is to provide a floatation device that will maintain, in an emergency situation, an infant carrier in a specific attitude when the infant carrier is floating in water.

Still a further object of the invention is to provide a floatation device of a bright color with high visibility to bring attention to the seat or carrier when it is positioned on a dock, next to a pool or in a similar environment. The high visibility provided by the floatation device would also provide for quickly locating the seat and floatation device in the water. Visibility also is improved by the incorporation of reflective panels attached to the floatation device to reflect light.

Another advantage of the invention is that it can be used on infant carriers of different manufacturers as it can be made in a nearly universal configuration to fit many sizes and styles of child carriers.

One more advantage of the floatation device is that its design is such that it does not interfere with the child's forward view nor does it block the parent or guardian's view of the child in the child carrier.

Another advantage is that the floatation device as contemplated is easy to manufacture and ship as it is lightweight and can be made foldable or collapsible into a small package.

BRIEF DESCRIPTION OF THE DRAWINGS

The invention will be understood by reading this disclosure in conjunction with a review of the drawing figures, in which;

FIG. 1 is a floatation structure embodiment;

FIG. 2 depicts a cross section of flotation material as taken through section 2—2 of FIG. 1;

FIG. 5 is another alternative embodiment of the invention wherein the vertical hoop is bifurcated and connected by a web of material.

FIG. 6 is a representation presentation of the cross section of another embodiment of the invention where the foam material of the first and second elements is stacked in layers.

DESCRIPTION OF PREFERRED EXEMPLARY EMBODIMENTS

Figure 3:
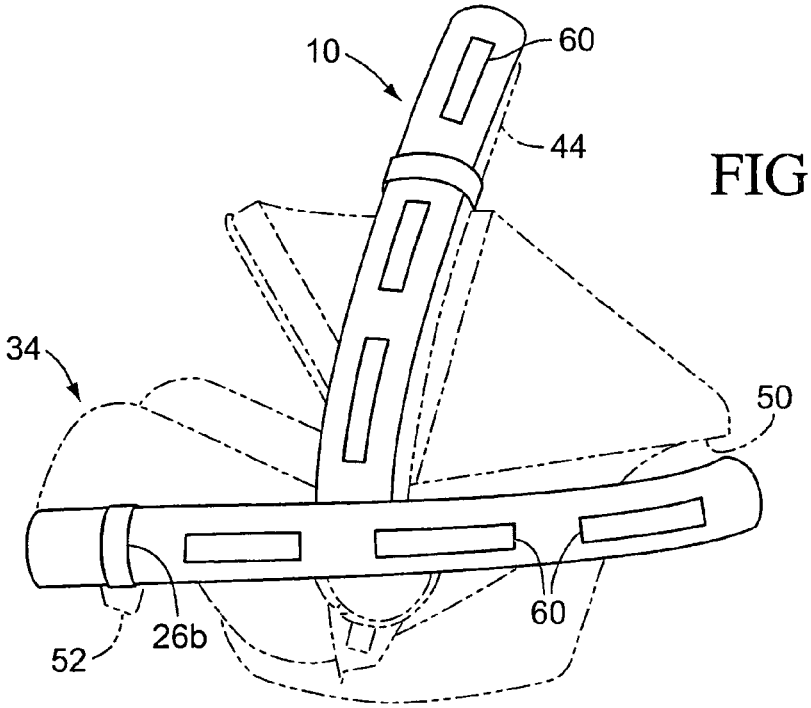
FIG. 3 shows the floatation structure of FIG. 1 attached to and positioned on an infant carrier, the infant carrier is shown in a broken line presentation in this figure.

The floatation device, generally 10, is shown in FIG. 1.

The device of FIG. 1 includes a first floatation element, that is a first hoop 12, defining, in this preferred embodiment a horizontal U-shaped form. An outer cover 14 contains a flotation component, in this case, a tube of closed cell flexible foam, shown as 16 in FIG. 2. The tube comprising the floatation element, in the prototype constructed by the applicant, is made from a water toy known, somewhat generically, as a "noodle." It is expected that other cross sectional shapes will perform in an acceptable manner, for instance, in addition to the round cross section shown, a rectangular, square, or oblong cross sectional shapes are all contemplated. The selection of the shape will be determined by an applications engineer having experience in personal floatation devices based on the need for a certain degree of flotation in conjunction with packaging and "fit-up" considerations. For instance, FIG. 6 shows a generally square cross sectional embodiment wherein the foam material 16 *a*–*c* is stacked in layers to form the first element or hoop 12 and second element or hoop 20. An outer cover 14*a* may surround the layers of foam.

As shown in FIG. 2, the flotation element is shown having a central aperture. This is optional, and perhaps desirable as it may provide improved floatation, particularly if the ends of the "noodle" are sealed or capped.

The outer cover of the first hoop is constructed of a waterproof, ultraviolet resistant fabric such as a woven nylon or polyethylene fabric as is frequently used as the cover material in personal floatation devices, life jackets and the like. The material will be abrasion resistant, flexible, non-abrasive and waterproof but breathable such that when the flotation device is placed in and then removed from water the fabric will allow complete drying of the flotation device, much as a life jacket will dry out when not in use. Alternative materials also are contemplated. For instance, a "rip-stop" nylon cover, a breathable membrane material, an open mesh material, and similar materials as would be known to the designer of PFDs, would all suffice to make a viable cover material.

As an alternative to the foam filled outer cover the inventor also contemplates the use of an inflatable bladder 14*b* as represented in FIG. 7 which is a pictorial cross section of the first element of the device. In this embodiment the floatation enhancing media is an air-tight bladder.

The ends of the first hoop 12 may be stitched closed as shown at 18 in FIG. 1, heat sealed shut, or provided with a zipper or hook and loop closure, such as Velcro brand hook and loop fasteners, to seal the ends of the fabric of the hoop 12. In one embodiment of the invention the ends of the hoop 12 are left open which will allow drainage of the tube if necessary.

A vertical hoop 20, this being the second floatation element, is fastened to the first hoop 12 at locations 22 and 24 in FIG. 1. The preferred form of attachment is to stitch the two components together as is shown in FIG. 1. Of course, other methods of attachment are contemplated. For instance, the connection could be a heat weld, a hook and loop tape connector, an adhesive connection, or the like. It may also be possible, and it is contemplated, that there could be a seamless connection wherein the two sections of the floatation device are formed as a single unitary structure.

The vertical hoop 20 is similar to the first hoop 12 in that it is made up of a sleeve of material that contains a flotation component such as the tube of closed cell flexible foam. The cross sectional view of the vertical hoop will be similar to the cross section 2—2 as shown in FIG. 1 and FIG. 2.

An alternative design of the flotation device does away with the fabric sleeve and just relies on the formed flotation element, such as the "noodle," to provide the exterior surface of the flotation unit.

The flotation device is attached by a parent or guardian to the baby seat or infant carrier when the carrier is expected to be proximate a water hazard. An attachment strap 26, comprised of two sections 26*a* and 26*b*, having a connector component 28, with two elements 28*a* and 28*b*, is attached to and extends from one leg 30 of the first hoop to a second leg 32 of the first hoop. This attachment strap 26 will be hooked, by connecting the components of the connector component 28, in position toward the front of and generally under the front portion of the infant carrier generally 34 in FIG. 3. The strap 26 passes below the front edge of the infant carrier from the one leg 30 of the first hoop 12 to the second leg 32 of the first hoop 12. Locating the connector component under the front lip of the infant carrier pod will assist in preventing the child from playing with the connector and possible releasing it.

A strap 36 is positioned, and, in a preferred embodiment, fixedly attached, on the vertical hoop generally in location 38. A similar strap 40 is positioned in location 42 on the vertical hoop 20. These straps, 36 and 40 provide an attachment mechanism to attach the vertical hoop 20 to the handle (item 44 FIG. 3) of the infant carrier generally 10 in FIG. 3. The connectors, 46 and 48, on these two straps are conventional connectors, such as the push and latch connectors shown. Alternatively, the connectors may be buckles, snaps, hook and loop fasteners, or the like. A secure connection is, of course, desirable. Also, the placement of the strap connectors out of the reach of a baby in the child carrier would be desirable.

The location of the attachment straps is a selection that will be made by the implementing designer as the designer designs a particular embodiment of the invention.

An alternative embodiment of the invention shown in FIG. 1 is presented as FIG. 5. This embodiment incorporates all the features of the FIG. 1 embodiment with the exception of having a split upper hoop 20 of FIG. 1. In FIG. 5 the hoop is truncated into two parts, a left side portion 21 and a right side portion 23. These two elements are connected by a web or strap 25 which is sewn or otherwise attached to the left and right side portions. The strap 25 provides continuity between the left and right side portions. In certain situations it is advantageous to reduce the bulk, comprised of the flotation material, at the top of the center hoop so that when the device is attached to the hoop of the child carrier the structural handle of the carrier can be easily grasped. In some cases, for instance where the child carrier has a handle of significant girth, it is cumbersome if the handle and the flotation hoop both have to fit into the grasping hand of the person carrying the child carrier.

An alternative to the strap 25, the inventor contemplates a section of the fabric cover be unfilled with floatation material at the upper portion of the inverted U-shaped member. This allows the tube to become a relatively flat bridge between a left 21 and a right 23 side portion of the inverted U.

Figure 4:
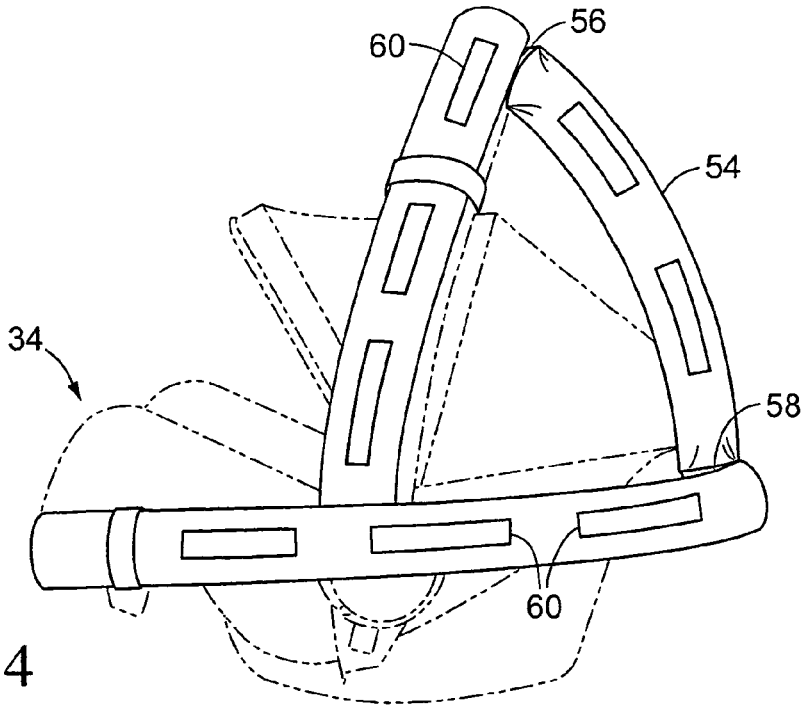
FIG. 4 is an alternative embodiment of the invention having an auxiliary floatation element.

The FIG. 5 embodiment is expected to accommodate the auxiliary floatation member 54 as shown in FIG. 4 by either attaching the auxiliary member to the strap or bridge of material at a point between the left and right side portions of the alternative hoop structure, or by angling the auxiliary flotation member to the left or right side portion of the structure. Further floatation is provided if two auxiliary floatation members are provided (not shown). One end of each could then be attached at an upper end to one each of the left and right side portions.

Another embodiment of the invention is a modification to the embodiment shown in FIG. 1. The alternative is to attach a strap to the top of the inverted hoop shaped member such that a strap handle is provided. This would enable a full hoop of flotation material while also providing a bulk free handle that is easy to grasp.

Returning now to the preferred embodiment of the invention, as touched on above, FIG. 2. shows a cross section to the floatation hoop or first hoop 12. The outer component is the fabric cover 14 and the interior component is the floatation component 12. In a simple embodiment, and a preferred embodiment, the flotation component is a tube of closed cell flexible foam having low density and thus very "floatable." This first hoop 12, as shown in each of the figures, will be one of the components that will support the infant carrier in or on the water. In some instances, it will be the only component that will support the infant carrier when it is in the water. In another embodiment, the infant carrier will have a degree of floatation built into it either by having a floatable cushion and/or a sealed infant carrier structure that will have natural buoyancy, although there are possible disadvantages in these alternative designs. For instance, if a buoyant seat cushion is carried in the tub of the infant carrier it could prevent the infant carrier from properly righting itself when submerged. Also, depending on fastening situations, a buoyant seat cushion could float out from under the infant.

To use the floatation structure described above the child carrier, if a convertible baby car seat type, will be removed from the car generally leaving a semi-permanent support still strapped in the car. The vertical hoop 20 will be positioned proximate the carrying handle and the straps 36 and 40 will be buckled around the carrying handle as shown in FIG. 3. The first hoop 12 will then be fastened to the carrier by positioning the curved section of the U-shaped first hoop under the rear lip 50, FIG. 3, of the child carrier. The front portion of the first hoop, that is both "legs" of the U-shape, are directed toward the front of the carrier. The ends of the attachment strap, 26*a* and 26*b*, are snapped together using the connector 28. The attachment strap 26 will pass under and behind or inboard of the front lip 52 of the carrier. It is contemplated that multiple straps may be used to secure the horizontal and vertical flotation components to the carrier. This is a design choice to be determined by the designer implementing the design of the invention presented. For instance, a strap could be used to connect the curved portion of the U-shape to the back of the carrier. Another alternative is that a strap or web could extend from the curved portion to the forward portion of the legs of the U-shaped flotation device. This may increase security of the attachment of the floatation device to the carrier. With the floatation device secured to the child carrier it would be educational and prudent to then test the integrity of the mounting by placing a simulated load having the general weight and center of gravity of the infant or child to be placed in the carrier and then tossing the childless child carrier into a significant body of water, to simulate a mishap and to validate the security and capacity of the flotation device.

The self-righting aspect of the floatation structure is enhanced by the vertical floatation element 20. With proper material choice, as has been done in the prototype, particularly with respect to the density and quantity of the buoyant material, the child carrier will be urged to roll around the major axis of the child carrier until the carrier attains a natural position of repose with the first hoop 12 generally floating horizontally on the surface of the body or water. In several occurrences in this specification the phrase "significant body of water" is used. This is to indicate that the contemplated structure will need both vertical and horizontal space or clearance to have room to self-right without getting caught or hung up on under-water obstacles. For instance, the self righting capability will be seriously compromised if the carrier is wedged or stuck under a dock, a boat, or other structure. Furthermore, if the water is so shallow that little or no significant surface area of the hoop 20 is submerged there will not be sufficient buoyancy force to self-right the infant carrier.

A plurality of optional reflective tape strips, such as items 60 in FIGS. 1, 3 and 4 may be affixed to the floatation device to aid in its visibility in low light conditions.

FIG. 4 provides an alternative embodiment of the invention. In this embodiment an auxiliary floatation member 54 is attached at junction 56 to the vertical flotation element 20 at a point high on the vertical floatation element as shown. The auxiliary floatation member 54 is also attached at second junction 58 to the first hoop 12. It is believed that this, as well as a plurality of auxiliary flotation members, such as the one shown as item 54, will provide even further buoyancy to the structure. The optimum placement, and even its ultimate desirability, has to be determined by empirical tests to determine its affect on the center of gravity of an occupied carrier. The location; size; number, whether one or more; floatation contribution of the auxiliary flotation member or added members; will be determined by an applications designer or engineer to assure the efficacy and need for the auxiliary floatation member.

In one embodiment of the invention a child carrier is provided that will enhance the avoidance of an accident in a deep water environment. The carrier comprises a seat portion having a first side, a back, a second side, and a front. The sides, the back and the front terminate at an upper edge of the seat. A handle is attached to the seat, generally to the first and second sides of the seat portion, the handle extends over the seat, like a hoop or handle, from the first side of the seat to the second side of the seat. That describes a child car seat or infant carrier known in the market. The improvement provided herein comprises a floatation element attached to the child carrier. The first flotation element is positioned on the seat to extend along the first side of the seat, around the back of the seat and along the second side of the seat. A second flotation element extends from the first flotation element proximate the first side of the seat to that portion of the first flotation element proximate the second side of the seat. The second floatation element forms something of a hoop extending upwardly from one part of the first element proximate the handle of the carrier to the first element on the second side of the seat also proximate the handle attachment point. To secure the second flotation element to the hoop or carrying handle, the second floatation element is attached to the handle of the seat with a strap, a snap connection, or a flap like element. The first flotation element may be secured to the seat with a strap attached to the first floatation element. The strap extends along the front of the seat from one end of the first floatation element, a generally U-shaped member, to a second end of the first floatation element. The strap will pass, in one embodiment of a child carrier, below a lip at the front end of the seat, and thus secure the front portion of the first floatation element to the front portion of the baby seat. A second strap, and perhaps a plurality of straps, are attached to the first floatation element along its length and these straps, will assist in attaching the first floatation element to the seat of the carrier.

REGARDING THE SCOPE OF THE INVENTION AND CLAIMS

The inventor considers various elements of the aspects and methods recited in the claims filed with the application as advantageous, perhaps even critical to certain implementations of her invention. However, the inventor regards no particular element as being "essential," except as set forth expressly in any particular claim.

While the invention is described herein in terms of preferred embodiments and generally associated methods, the inventor contemplates that alterations and permutations of the preferred embodiments and methods will become apparent to those skilled in the art upon a reading of the specification and a study of the drawings. For instance, the size, cross-sectional shape, and density of the floatation elements could be varied to fit different child carriers and be engineered for different buoyancy characteristics depending on the actual or anticipated mass of the combined carrier and child to be supported. Of course, the elements used to attach the floatation members to the child carrier can be either the simple straps shown in FIGS. 1, 3 and 4, or they can be unique elements designed to fasten or make integral the floatation device with a child carrier.

Accordingly, neither the above description of preferred exemplary embodiments nor the abstract, defines or constrains the invention. Rather, the claims variously define the invention. Each variation of the invention is limited only by the recited limitations of its respective claim, and equivalents thereof, without limitation by other terms not present in the claim.

Each variation of the invention is limited only by the recited limitations of its respective claim, and equivalents thereof, without limitation by other terms not present in the claim. Likewise, the use of the words "function" or "means" in the Detailed Description of the Drawings is not intended to indicate a desire to invoke the special provisions of 35 U.S.C. 112, Paragraph 6, to define the invention. To the contrary, if the provisions of 35 U.S.C. 112, Paragraph 6 are sought to be invoked to define the inventions, the claims will specifically state the phrases "means for" or "step for" and a function, without also reciting in such phrases any structure, material or act in support of the function. Even when the claims recite a "means for" or "step for" performing a function, if they also recite any structure, material or acts in support of that means or step, then the intention is not to invoke the provisions of 35 U.S.C. 112, Paragraph 6. Moreover, even if the provisions of 35 U.S.C. 112, Paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later-developed equivalent structures, material or acts for performing the claimed function.

What is claimed is:

1. A child carrier comprising a seat portion having a first side, a back, a second side, and a front; the sides, the back and the front terminating at an upper edge of the seat, a handle attached to the seat and extending over the seat from the first side of the seat to the second side of the seat, the improvement comprising:

a first floatation element attached to the child carrier, the flotation element extending along the first side of the seat, around the back of the seat and along the second side of the seat;

a second flotation element extending from the first flotation element proximate the first side of the seat to that portion of the first flotation element proximate the second side of the seat, the second flotation element attached to the handle of the seat;

a first strap attached to the first floatation element, the strap extending along the front of the seat;

a second strap attached to the first floatation element and attached to the seat of the carrier.

2. The invention in accordance with claim 1 wherein the first and second elements are floatation enhancing media.

3. The invention in accordance with claim 2 wherein the flotation enhancing media is a foam material.

4. The invention in accordance with claim 3 wherein the foam material is a mass of expanded foam in the shape of an elongated tube.

5. The invention in accordance with claim 3 wherein the foam material is stacked in layers to form the first and second elements.

6. The invention in accordance with claim 2 wherein the floatation enhancing media is an air-tight bladder.

7. The invention in accordance with claim 2 wherein the floatation enhancing media is covered with a fabric cover.

8. The invention in accordance with claim 7 wherein the fabric cover comprises a synthetic woven material.

9. The invention in accordance with claim 7 wherein the fabric cover is a material having high visibility.

10. The invention in accordance with claim 2 wherein the floatation enhancing media is a material of high visibility.

* * * * *